US005711320A

United States Patent [19]

Martin

[11] Patent Number: 5,711,320

[45] Date of Patent: Jan. 27, 1998

[54] PROCESS FOR FLAVORING SHREDDED TOBACCO AND APPARATUS FOR IMPLEMENTING THE PROCESS

[75] Inventor: Mario Martin, Silea, Italy

[73] Assignee: Comas-Costruzional Machine Speciali-S.p.A., Silea, Italy

[21] Appl. No.: 464,817

[22] PCT Filed: Apr. 12, 1994

[86] PCT No.: PCT/EP94/01123

§ 371 Date: Jun. 29, 1995

§ 102(e) Date: Jun. 29, 1995

[87] PCT Pub. No.: WO94/23597

PCT Pub. Date: Oct. 27, 1994

[30] Foreign Application Priority Data

Apr. 20, 1993 [IT] Italy ..... VE93A0012

[51] Int. Cl.[6] ..... A24B 3/12

[52] U.S. Cl. ..... 131/305; 131/300

[58] Field of Search ..... 131/370, 290, 131/292, 300, 303, 304, 305; 426/474, 531, 600, 650, 651

[56] References Cited

U.S. PATENT DOCUMENTS

| | | | |
|---|---|---|---|
| 3,678,939 | 7/1972 | Key, III et al. . | |
| 3,704,716 | 12/1972 | Abbott et al. | 131/292 |
| 4,438,775 | 3/1984 | Mays et al. . | |
| 5,022,416 | 6/1991 | Watson | 131/305 |

FOREIGN PATENT DOCUMENTS

| | | |
|---|---|---|
| 0443711 | 8/1991 | European Pat. Off. . |
| 2075373 | 11/1981 | United Kingdom . |

*Primary Examiner*—Jennifer Bahr

[57] ABSTRACT

A process and apparatus for flavouring shredded tobacco by which a mixture of alcohol, water and flavouring essences are fed into a rotary cylinder, wherein the mixture is cooled to below ambient temperature before being fed into the cylinder.

10 Claims, 1 Drawing Sheet

PROCESS FOR FLAVORING SHREDDED TOBACCO AND APPARATUS FOR IMPLEMENTING THE PROCESS

FIELD OF THE INVENTION

This invention relates to a process for flavouring shredded tobacco and an apparatus for implementing the process.

BACKGROUND OF THE INVENTION

Tobacco flavouring processes for giving shredded tobacco the required fragrance are known. These processes generally consist of feeding an atomized mixture of alcohol, water and flavouring essences into a rotary cylinder filled with shredded tobacco, allowing the mixture to diffuse into the shredded tobacco, and then creating vacuum inside the cylinder by means of a centrifugal fan, to evaporate the excess atomized mixture.

This known process has however certain drawbacks, and in particular:

- a substantial operating cost due to the considerable intake of air to prevent dispersal of the alcohol within the environment,
- a high essence consumption necessary to ensure uniform flavouring of the shredded tobacco,
- the need to purify the exit air from the cylinder, possibly using an incinerator to burn the alcohol quantity concerned.

DISCUSSION OF THE PRIOR ART

GB-A-2075373 discloses an apparatus spraying atomized water, casing, plasticizer or another liquid additive onto a stream or tow of tobacco and having one or more single-material nozzles.

SUMMARY OF THE INVENTION

According to the invention a process for flavouring shredded tobacco by which a mixture of alcohol, water and flavouring essences are fed into a rotary cylinder, wherein the mixture is cooled to below ambient temperature before being fed into the cylinder.

To implement the process according to the invention an apparatus for implementing the process, comprising a shredded tobacco container provided with means for spraying a mixture of flavoring essences, wherein the mixture is fed along a pipe provided with a refrigeration unit.

BRIEF DESCRIPTION OF THE DRAWINGS

A preferred embodiment of the present invention is further described hereinafter with reference to the accompanying drawing, which represents a schematic side view of an apparatus for implementing the process of the invention.

DESCRIPTION OF THE PREFERRED EMBODIMENT

Figure 1:
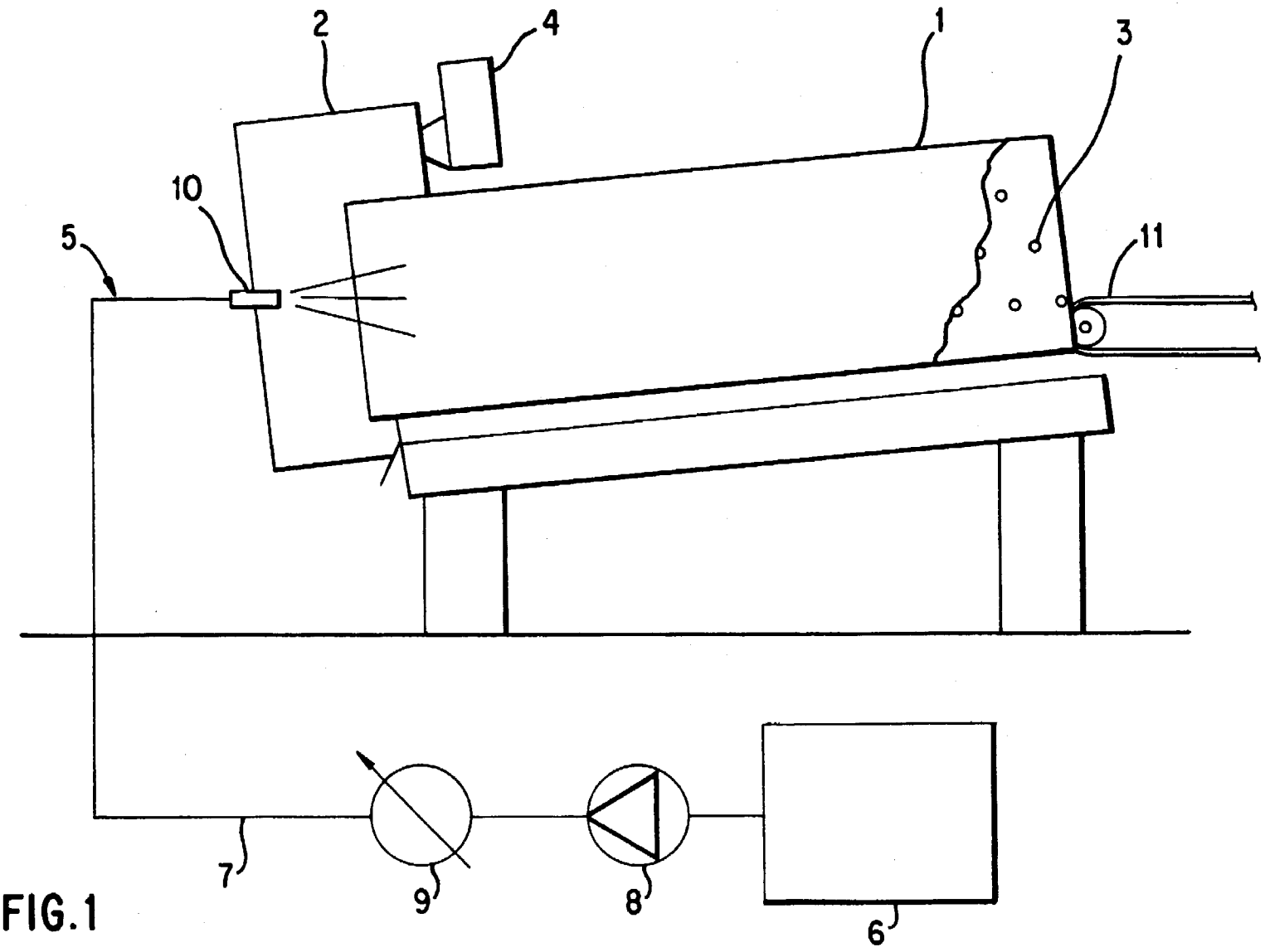

As can be seen from the drawing, the apparatus for implementing the process of the invention comprises substantially a rotary cylinder arranged slightly inclined, opened at the shredded tobacco feed end and closed at the other end by a discharge hopper 2.

The inner surface of the cylinder comprises a plurality of rows of pins 3, the purpose of which is clarified hereinafter.

The discharge hopper is provided with a centrifugal fan 4 able to create a slight vacuum inside the rotary cylinder 1.

The apparatus also comprises a spray device, indicated overall by 5 and consisting of a tank 6 containing the flavouring mixture, a pipe 7 with a feed pump 8, a refrigeration unit 9 and a nozzle 10 housed within the hopper 2 and facing the cylinder 1.

In the process of the invention, the shredded tobacco conveyed along a feed belt 11 is introduced into the rotary cylinder 1 and made to advance along it by the rotating pins 3. During this stage, the flavouring mixture, consisting generally of water, alcohol, glycol and flavouring essences and contained in the tank 6, passes through the refrigeration unit 9 and is cooled to a temperature substantially of between 0° and 5° C.

The mixture is then atomized through the nozzle 10 and fed into the cylinder to spray the mass of shredded tobacco which advances within it.

The mixture cooling results in a reduction in the vapour pressure of the alcohol which, by delaying its evaporation, can diffuse completely into the shredded tobacco to impregnate it in a virtually uniform manner.

To this must be added that, as evaporation is delayed, a smaller quantity of mixture is used with a consequent reduction in the cost of treating the air drawn through the centrifugal fan, as its throughput is reduced to a minimum.

I claim:

1. A process for flavoring shredded tobacco compromising:

introduction shredded tobacco to an inside of a rotary cylinder through a first opening of said rotary cylinder, advancing said shredded tobacco along said rotary cylinder, cooling an outside of said rotary cylinder, a liquid mixture of alcohol, water and flavoring essences to a temperature below ambient temperature, and atomizing said liquid mixture onto said shredded tobacco in correspondence of a second opening facing said first opening.

2. A process as claimed in claim 1, wherein the mixture is cooled to a temperature of between 0° and 5° C.

3. An apparatus for implementing the process claimed in claim 1, comprising:

a rotary cylinder, a shredded tobacco a means for feeding said shredded tobacco into said rotary cylinder, a means for advancing said shredded tobacco along said rotary cylinder, a container for holding a mixture of alcohol, water and flavoring essences, a means for cooling said mixture, and a means for atomizing said mixture onto said shredded tobacco.

4. An apparatus as claimed in claim 3, wherein said rotary cylinder is arranged slightly inclined.

5. An apparatus as claimed in claim 4, wherein the inner surface of the cylinder comprises a plurality of rows of pins.

6. An apparatus as claimed in claim 3, wherein the cooling means comprise a tank, a pipe with a feed pump, and a refrigeration unit.

7. An apparatus for implementing the process claimed in claim 2, comprising:

a rotary cylinder, a shredded tobacco a means for feeding said shredded tobacco into said rotary cylinder, a means for advancing said shredded tobacco along said rotary cylinder, a container for holding a mixture of alcohol, water and flavoring essences, a means for cooling said mixture, and a means for atomizing said mixture onto said shredded tobacco.

8. An apparatus as claimed in claim 7, wherein said rotary cylinder is arranged slightly inclined.

9. An apparatus as claimed in claim 8, wherein the inner surface of the cylinder comprises a plurality of rows of pins.

10. An apparatus as claimed in claim 7, wherein the means for cooling comprise a tank, a pipe with a feed pump and a refrigeration unit.

* * * * *